United States Patent [19]

Gudmundson

[11] Patent Number: 4,819,434

[45] Date of Patent: Apr. 11, 1989

[54] STEAM TURBINE

[76] Inventor: Chris R. Gudmundson, 3116 Merrywood Dr., Sacramento, Calif. 95825

[21] Appl. No.: 16,255

[22] Filed: Feb. 19, 1987

[51] Int. Cl.[4] ..... F01K 7/34

[52] U.S. Cl. ..... 60/653; 60/670

[58] Field of Search ..... 60/653, 670, 645

[56] References Cited

U.S. PATENT DOCUMENTS 3,035,557 5/1962 Litwinoff ..... 60/653

3,320,752 5/1967 Tawse ..... 60/653

*Primary Examiner*—Stephen F. Husar

*Attorney, Agent, or Firm*—Fliesler, Dubb, Meyer & Lovejoy

[57] ABSTRACT

The invention is concerned with an improvement in a steam turbine having a boiler having a first superheater, a first conduit having an inlet end and an outlet end, said outlet end being connected to said first superheater, a pressurized liquid working fluid source connected to said inlet end of said first conduit, said first superheater being adapted to convert said liquid working fluid to superheated vapor, a second conduit having an input end and an output end, said input end being connected to receive said vapor from said superheater, and a turbine connected to receive said vapor from said output end of said second conduit. The improvement comprises a structure for restricting flow through the second conduit. A third conduit is adapted to conduct a first portion of the superheated vapor from the second conduit from downstream of the restricting structure to a second superheater wherein the first portion of the superheated vapor is further superheated. The fourth conduit is adapted to conduct the further superheated vapor from the second superheater to the turbine. The result is improved utilization of the heat generated by the boiler whereby significant increases in output energy result.

20 Claims, 1 Drawing Sheet

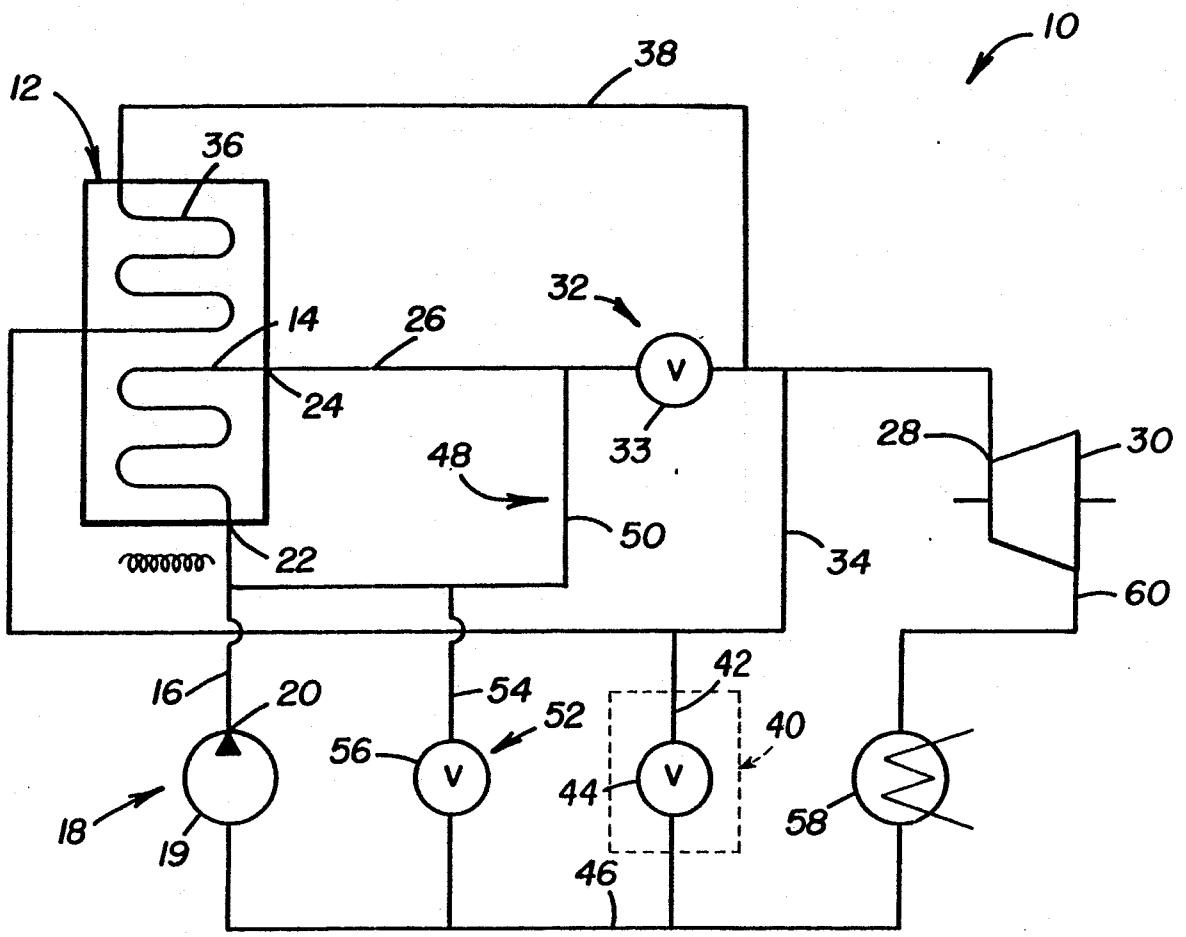
10
12
14
16
18
19
20
22
24
26
28
30
32
33
34
36
38
40
42
44
46
48
50
52
54
56
58
60

STEAM TURBINE

TECHNICAL FIELD

The present invention relates to a steam turbine apparatus and method having improved efficiency.

BACKGROUND ART

Many steam turbine apparatus are known for generating power. In a number of these systems some of the energy is reused in one way or another. The following patents are of interest in that they show the state of the art in this area as it now exists:

| Patent No. | Patentee(s) | Issue Date |
|---|---|---|
| 4,598,551 | Dimitroff, Jr., et al | 7-08-86 |
| 4,558,228 | Larjola | 12-10-85 |
| 4,514,642 | Ross | 4-30-85 |
| 4,487,166 | Haller, et al | 12-11-84 |
| 4,445,180 | Davis, et al | 4-24-84 |
| 4,316,362 | Ninomiya, et al | 2-23-82 |
| 4,309,873 | Koran, et al | 1-12-82 |
| 4,287,430 | Guido | 9-01-81 |
| 4,282,708 | Kuribayashi, et al | 8-11-81 |
| 4,277,943 | Silvestri, Jr., et al | 7-14-81 |
| 4,274,259 | Silvestri, Jr. | 6-23-81 |
| 4,241,585 | Gorzegno | 12-30-80 |
| 4,226,086 | Binstock, et al | 10-07-80 |
| 4,173,124 | Fujii, et al | 11-06-79 |
| 4,130,992 | Bitterlich, et al | 12-26-78 |
| 4,099,384 | Stevens, et al | 7-11-78 |
| 4,068,475 | Binstock | 1-17-78 |
| 3,935,710 | Dickinson | 2-03-76 |
| 3,898,842 | Luongo | 8-12-75 |
| 3,813,884 | Ishikawa | 6-04-74 |
| 3,724,212 | Bell | 4-03-73 |
| 3,675,423 | Vidal, et al | 7-11-72 |
| 3,572,036 | Beckman, et al | 3-23-71 |
| 3,423,941 | Evans | 1-28-69 |
| 3,362,164 | Rudd | 1-09-68 |
| 3,359,732 | Schuetzenduebel, et al | 12-26-67 |
| 3,304,716 | Griffin, et al | 2-21-67 |
| 3,277,651 | Augsburger | 10-11-66 |
| 3,271,961 | Wiener | 9-13-66 |
| 3,243,961 | Caracristi | 4-05-66 |
| 3,242,678 | Kochey, Jr. | 3-29-66 |
| 3,205,664 | Nettel | 9-14-65 |
| 2,743,583 | Bayard | 5-01-56 |

The above listed patents illustrate that a number of attempts, of varying success, have been made to improve the efficiency of steam turbine apparatus. Thus, the prior art recognizes that such an improvement is desirable.

DISCLOSURE OF INVENTION

The present invention is directed to a steam turbine apparatus and method characterized by relatively high efficiency operation.

In accordance with an embodiment of the present invention an improvement is set forth in a steam turbine apparatus having a boiler which heats a working fluid passing through a first superheater, a first conduit having an inlet end and an outlet end, the inlet end being connected to the first superheater, a pressurized working fluid source connected to the inlet end of the first conduit, the first superheater being adapted to convert the working fluid to superheated vapor. A second conduit has an input end and an output end, the input end being connected to receive the vapor from the first superheater. A turbine is connected to receive the vapor from the output end of the second conduit. The improvement of the invention comprises restricting means for restricting flow through the second conduit. The improvement also includes a second superheater and a third conduit from downstream of the restricting means to the second superheater wherein a first portion of the vapor is further superheated. A fourth conduit is adapted to conduct the further superheated vapor from the second superheater to said turbine.

In accordance with another embodiment of the present invention a method is set forth for improving the efficiency of a steam turbine apparatus having a boiler having a first superheater, a first conduit having an inlet end and an outlet end, the outlet end being connected to the first superheater, a pressurized working fluid source connected to the inlet end of the first conduit, the first superheater being adapted to convert the working fluid to superheated vapor, a second conduit having an input end and an output end, the input end being connected to receive the vapor from the first superheater, and a turbine connected to receive the vapor from the output end of the second conduit. The method comprises restricting flow through the second conduit at a site therein; conducting a first portion of the vapor from the second conduit from downstream of the restricting site; superheating the first portion of the vapor; and conducting the further superheated vapor into the second conduit downstream of the restricting site.

Operation in accordance with the present invention provides significantly improved efficiency of operation for a steam turbine apparatus. As a result, from a given amount of fuel used in the boiler a relatively large amount of energy is produced by the turbine. And, all this is accomplished with relatively inexpensive modifications of the steam turbine apparatus.

BRIEF DESCRIPTION OF DRAWINGS

The single FIGURE of the drawing illustrates, schematically, a steam turbine apparatus in accordance with an embodiment of the present invention.

BEST MODE FOR CARRYING OUT INVENTION

The present invention is concerned with an improved steam turbine apparatus 10 as illustrated in the drawing. The apparatus 10 includes a boiler 12 which has a first superheater 14 wherein a working fluid is delivered via a first conduit 16 from a pressurized liquid working fluid source 18, which may be in the nature of a conventional pump 19. Alternatively, the pressurized working fluid source can be simply a water main. The working fluid is generally water and, when delivered through the first conduit 16, is generally in liquid form.

The first conduit 16 has an inlet end 20 connected to the pressurized fluid source 18 and an outlet end 22 connected to the first superheater 14. The superheated vapor, usually steam, exiting the first superheater 14, and which has been produced from the working fluid, enters an input end 24 of a second conduit 26. An output end 28 of the second conduit 26 delivers the superheated vapor from the second conduit 26 to a turbine 30.

In accordance with the present invention restricting means 32, generally adjustable restricting means in the nature of a throttle valve 33, is provided for restricting flow through the second conduit 26. The efficiency of operation of the apparatus 10 of the present invention is partially dependent on the amount of restriction provided by the restricting means 32. The precise amount of restricting needed for optimal operation is a function of each turbine apparatus and can readily be determined by minimal experimentation. Such experimentation is easily done if the restricting means 32 is the throttle valve 33.

A third conduit 34 is adapted to conduct a first portion of the superheated vapor from the second conduit 26 from downstream of the restricting means 32 and to deliver the first portion of the superheated vapor to a second superheater 36 wherein the superheated vapor is further superheated. The further superheated vapor from the second superheater 36 is conducted to the turbine 30, generally via a fourth conduit 38 which feeds into the second conduit 26 downstream of the restricting means 32. Suitably, the fourth conduit conducts the further superheated vapor into the second conduit 26 between the restricting means 32 and the position whereat the third conduit 34 removes superheated vapor from the second conduit 26.

It should be noted that some of the superheated vapor taken from the second conduit 26 by the third conduit 34 may condense to form liquid working fluid. Accordingly, means 40 can be provided for separating liquid working fluid from the third conduit 34 and for delivering the thus separated liquid working fluid to the pump 19. In the embodiment illustrated this is accomplished by adding a fifth conduit 42 which connects, via a valve 44, to a return line 46 to the pump 19.

Also in accordance with the present invention recycling means 48 can be provided for further improving efficiency by recycling a second portion of the superheated vapor from the second conduit 26, from intermediate the first superheater 14 and the restricting means 32, to the first conduit 16. In the embodiment illustrated the recycling means 48 is in the nature of a sixth conduit 50.

In such an apparatus it may be desirable to provide means 52 for separating liquid working fluid from the vapor recycled by the recycling means 48 and for delivering the liquid working fluid to the pump 19. In the embodiment illustrated this is accomplished by a seventh conduit 54 which branches off of the sixth conduit 50 and connects with the return line 46 via an appropriate valve 56.

It may also be desirable in the apparatus of the present invention to include a condenser 58 which is adapted to condense the vapor which exits the turbine 30 to the form of liquid working fluid and to deliver the liquid working fluid to the pump 19. In the embodiment illustrated the spent vapor from the turbine 30 passes via an eighth conduit 60 to the condenser 58 and the return line 46 exits the condenser 58 and proceeds to the pump 19, as previously set forth.

In accordance with the method of the present invention superheated vapor from the first superheater 14 of the boiler 12 passes through the restricting means 32. Downstream of the restricting means 32 a portion of the vapor is recirculated via the second superheater 36. The further superheated steam, along with that portion of the originally superheated steam which has not been further heated, is used to run the turbine 30. In this manner much more efficient utilization is made of the heat in the boiler 12 and, accordingly, much higher energy outputs are available from the turbine 30.

All of this was checked experimentally utilizing an apparatus 10 as shown in the Figure modified as described in following:

1. The system as shown was run with tap water (the liquid working fluid source 18 was a tap) as an input to the first superheater 14 and the spent steam from the turbine was vented to the atmosphere. The length of the tubing in the first superheater was over 100 feet and, except as noted below, was identical for each mode tested.
2. In the first and fourth modes tested the third conduit 34 was disconnected as was the fourth conduit 38, and their connections to the second conduit 36 were capped off.
3. In all modes the valve 56 was closed, as well.
4. In the second mode the length of tubing of the second superheater 36 was 42 inches.
5. In the third mode the length of the tubing of the second superheater 36 was 692 inches.
6. In the fourth mode tested the length of the tubing of the first superheater 14 was increased by 692 inches.

Each mode was run for 35 minutes using substantially the same amount of fuel and the following quantities were measured:

A. total number of revolutions of the turbine in 35 minutes;
B. total external work in btus in 35 minutes; and
C. total pounds of steam produced in 35 minutes.

The following table list the results of such testing.

TABLE 1

| Mode | Total Turbine Revs., 35 mins. | External Work btu, 35 mins. | Total lbs steam, 35 mins. |
|---|---|---|---|
| 1 | 24,500 | 8,754 | 109.9 |
| 2 | 27,600 | 11,753 | 145.6 |
| 3 | 32,900 | 15,077 | 187.0 |
| 4 | 27,000 | 12,770 | 158.2 |

As will be apparent from the above tabulation a very significant increase in efficiency is provided in a steam turbine apparatus when it is constructed and run in accordance with the teachings of the present invention. Furthermore, it is important that the second superheater 36 be used since merely increasing the length of the first superheater 14 by the length of the second superheater 36 does not result in even a nearly equivalent improvement in efficiency (compare modes 3 and 4).

INDUSTRIAL APPLICABILITY

The present invention provides a steam turbine apparatus 10 as well as an improved method of running such an apparatus, which turbine apparatus 10 is useful for producing power, for example electrical power.

Other aspects, objectives and advantages of this invention can be obtained from a study of the drawings, the disclosure and the appended claims.

What is claimed:

1. In a steam turbine apparatus having a boiler having a first superheater, a first conduit having an inlet end and an outlet end, said outlet end being connected to said first superheater, a pressurized liquid working fluid source connected to said inlet end of said first conduit, said first superheater being adapted to convert said liquid working fluid to superheated vapor, a second conduit having an input end and an output end, said input end being connected to receive said vapor from said first superheater, and a turbine connected to receive said vapor from said output end of said second conduit, an improvement comprising:

restricting means for restricting flow through said second conduit;

a second superheater;

a third conduit adapted to conduct a first portion of said superheated vapor from said second conduit from downstream of said restricting means to said second superheater wherein said first portion of said superheated vapor is further superheated; and a fourth conduit adapted to conduct said further superheated vapor from said second superheater to said turbine.

2. An improved steam turbine apparatus as set forth in claim 1, wherein said fourth conduit conducts said further superheated vapor into said second conduit downstream of said restricting means.

3. An improved steam turbine apparatus as set forth in claim 1, wherein said restricting means comprises a throttle valve.

4. An improved steam turbine apparatus as set forth in claim 1, further including:

recycling means for recycling a second portion of said superheated vapor from said second conduit from intermediate said first superheater and said restricting means to said first conduit.

5. An improved steam turbine apparatus as set forth in claim 1, wherein said fourth conduit conducts said further superheated vapor to said second conduit upstream of from where said third conduit conducts said first portion of said vapor to said second superheater.

6. An improved steam turbine apparatus as set forth in claim 1, wherein said pressurized liquid working fluid source comprises a pump, and further including:

a condenser adapted to condense said vapor exiting said turbine into said liquid working fluid and deliver said condensed liquid working fluid to said pump.

7. An improved steam turbine apparatus as set forth in claim 6, further including:

recycling means for recycling a second portion of said superheated steam from said second conduit, from intermediate said first superheater and said restricting means, to said first conduit.

8. An improved steam turbine apparatus as set forth in claim 7, further including:

means for separating liquid working fluid from said vapor recycled by said recycling means and for delivering said liquid working fluid to said pump.

9. An improved steam turbine apparatus as set forth in claim 8, further including:

means for separating liquid working fluid from said third conduit and for delivering said liquid working fluid to said pump.

10. An improved steam turbine apparatus as set forth in claim 1, further including:

means for separating liquid working fluid from said third conduit and for delivering said liquid working fluid to said pump.

11. An improved steam turbine apparatus as set forth in claim 10, wherein said restricting means comprises a throttle valve.

12. An improved steam turbine apparatus as set forth in claim 11, further including:

recycling means for recycling a second portion of said superheated vapor from said second conduit, from intermediate said first superheater and said restricting means, to said first conduit.

13. An improved steam turbine apparatus as set forth in claim 10, wherein said fourth conduit conducts said further superheated vapor to said second conduit upstream of from where said third conduit conducts said first portion of said vapor to said second superheater.

14. An improved steam turbine apparatus as set forth in claim 13, wherein said pressurized liquid working fluid source comprises a pump, and further including:

a condenser adapted to condense said vapor exiting said turbine into said liquid working fluid and deliver said condensed liquid working fluid to said pump.

15. An improved steam turbine apparatus as set forth in claim 14, further including:

recycling means for recycling a second portion of said superheated vapor from said second conduit, from intermediate said first superheater and said restricting means, to said first conduit.

16. An improved steam turbine apparatus as set forth in claim 15, further including:

means for separating liquid working fluid from said vapor recycled by said recycling means and for delivering said liquid working fluid to said pump.

17. A method of improving the efficiency of a steam turbine apparatus having a boiler having a first superheater, a first conduit having an inlet end and an outlet end, said outlet end being connected to said first superheater, a pressurized liquid working fluid source connected to said inlet end of said first conduit, said first superheater being adapted to convert said liquid working fluid to superheated vapor, a second conduit having an input end and an output end, said input end being connected to receive said vapor from said first superheater, and a turbine connected to receive said vapor from said outlet end of said second conduit, comprising:

restricting flow through said second conduit at a site therein;

conducting a first portion of said superheated vapor from said second conduit from downstream of said restricting site to a second superheater wherein said first portion of said superheated vapor is further superheated; and conducting said further superheated vapor from said second superheater to said turbine.

18. A method as set forth in claim 17, further including:

recycling a second portion of said superheated vapor from said second conduit, from intermediate said first superheater and said restricting site, to said first conduit.

19. A method as set forth in claim 18, further including:

separating liquid working fluid from said vapor recycled by said recycling; and delivering said liquid working fluid, under pressure, to said first conduit.

20. A method as set forth in claim 19, further including:

separating liquid working fluid from said first portion of said superheated vapor; and delivering said liquid working fluid, under pressure, to said first conduit.

* * * * *